US006302812B1

(12) United States Patent
Perry

(10) Patent No.: US 6,302,812 B1
(45) Date of Patent: Oct. 16, 2001

(54) HYBRID COMPOSITE RACKET FRAME

(75) Inventor: Richard G. Perry, Surry (GB)

(73) Assignee: Dunlop Slazenger Group Limited, Camberely (GB)

( * ) Notice: Subject to any disclaimer, the term of this patent is extended or adjusted under 35 U.S.C. 154(b) by 0 days.

(21) Appl. No.: 09/454,000

(22) Filed: Dec. 3, 1999

(30) Foreign Application Priority Data

Dec. 3, 1998 (GB) ..... 9826673

(51) Int. Cl.[7] ..... A63B 49/10
(52) U.S. Cl. ..... 473/535
(58) Field of Search ..... 473/535, 536

(56) References Cited

U.S. PATENT DOCUMENTS 4,028,477 * 6/1977 Goppel et al. ..... 442/373
4,070,019 * 1/1978 Segal et al. ..... 473/536
4,604,319 * 8/1986 Evans et al. ..... 442/164
4,643,857 * 2/1987 Cousin et al. ..... 473/535 X
4,770,915 * 9/1988 Nakagawa et al. ..... 428/74
4,913,434 * 4/1990 Fischer ..... 473/535
5,076,872 * 12/1991 Nakagawa et al. ..... 156/166
5,770,313 * 6/1998 Furumoto et al. ..... 428/411.1

* cited by examiner

*Primary Examiner*—Raleigh W. Chiu
(74) *Attorney, Agent, or Firm*—Lorusso & Loud

(57) ABSTRACT

A games racket frame comprising a main frame (1) in the form of a hollow tubular structure made of a fibre reinforced composite including a thermosetting material, and at least one additional component (2, 3 or 4) including a thermoplastic material and integrated with the main frame (1) in order to improve the vibration damping characteristics of the main frame. The additional component (2, 3, or 4) is preferably made of a composite comprising the thermoplastic material and a discontinuous fibre reinforcement, and can form the bridge of the racket frame.

6 Claims, 2 Drawing Sheets

FIG. 5
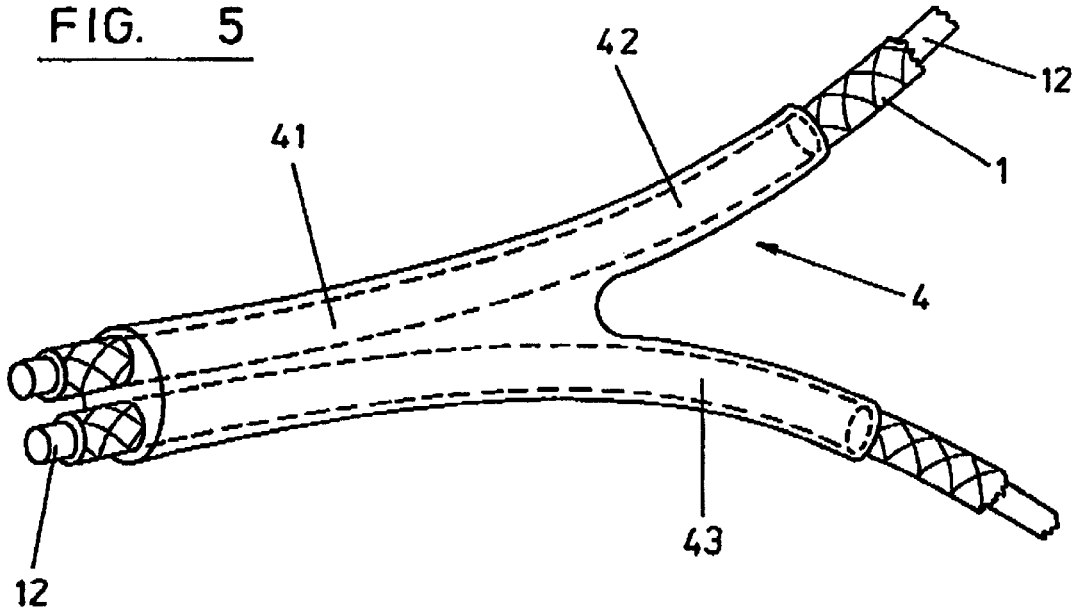
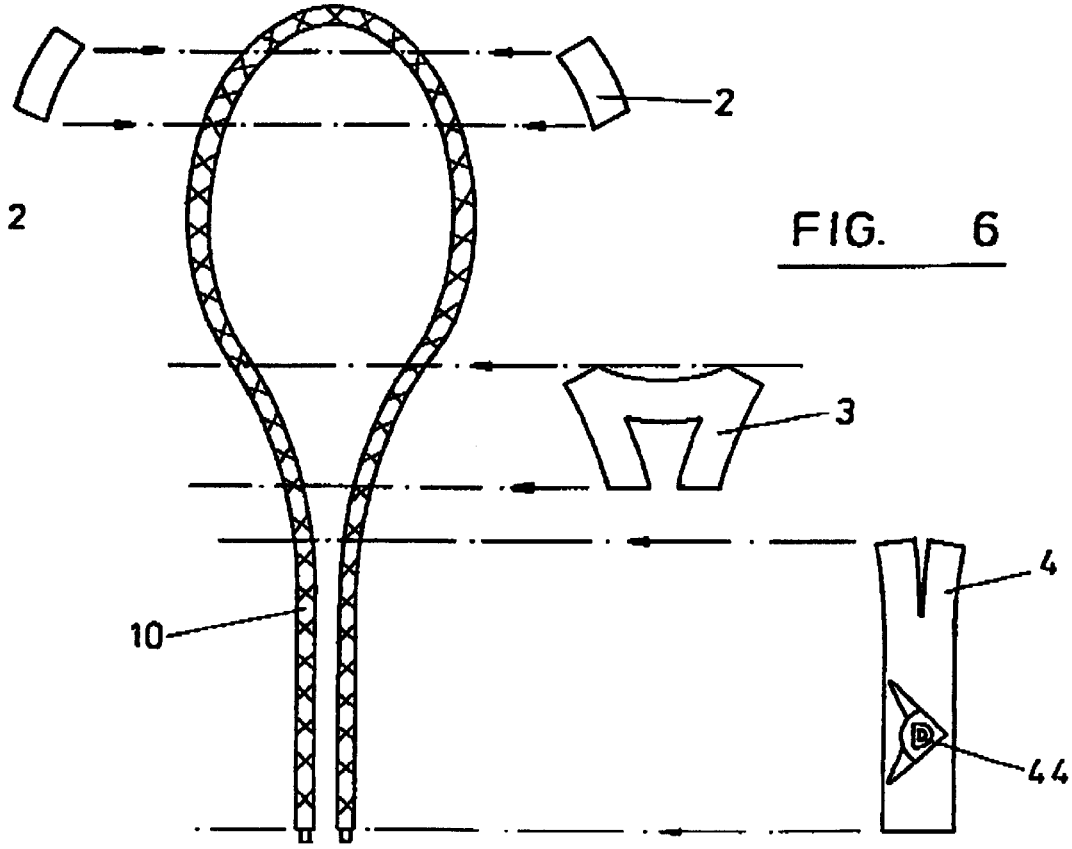
FIG. 6

HYBRID COMPOSITE RACKET FRAME

BACKGROUND OF THE INVENTION

Field of the Invention

The present invention relates to a games racket frame, more particularly, but not exclusively, a racket frame for use in tennis, squash or badminton.

Rackets for the games of tennis, squash and badminton need to be stiff, strong and light. Better quality racket frames are now made from composite materials composed of fibres of carbon, glass or aramid (or combinations of these) in a matrix of a thermosetting resin, usually epoxy resin. The fibres are usually in continuous form and are made into sheet material for subsequent processing, either by weaving into a fabric which is then coated with resin or alternatively by assembling the fibres in parallel where they are located together by the adhesive qualities of the resin coating subsequently applied.

Rackets constructed in the above way are generally satisfactory except as regards vibration damping. That is, vibrations occurring in the racket upon impact with a ball or shuttlecock are insufficiently damped, resulting in a shock to the hand and arm of the player.

Consequently, there is a need for a games racket frame having improved vibration damping characteristics.

SUMMARY OF THE INVENTION

According to one aspect of the present invention, there is provided a games racket frame, comprising: a main frame in the form of a hollow tubular structure made of a fibre reinforced composite including a thermosetting material; and at least one additional component including a thermoplastic material and integrated with the main frame in order to change the vibration characteristics of the main frame.

Preferably, the additional component is fitted around the hollow tubular structure of the main frame; this can be achieved by providing at least one internal through hole through which the main frame is inserted.

Preferably also, the main frame is a modulated frame and the additional component is consolidated into the main frame during the moulding process.

Embodiments of the invention include: (i) two additional components, one at each of two corresponding points on either side of the racket frame; (ii) an additional component forming the bridge of the racket frame, so as to join together two portions of the main frame; and (iii) an additional component provided at a shaft of the main frame, passing around two parallel portions of the hollow tubular structure. Any combination of these embodiments is possible.

In the case of (i), each additional component is preferably a hollow cylinder, the axis of which is curved to fit the tubular structure at the part of the head where it is positioned. In the case of (ii), the additional component preferably comprises two legs each of similar form as in (i) and joined by an integrally-formed cross-piece. In the case of (iii), preferably the additional component comprises a body passing around both portions of the tubular structure, and two legs extending from the body along respective single portions of the tubular structure.

For the materials of the main frame and additional component(s), a composite of carbon fibre and epoxy resin is preferably used for the main frame, and for the additional component, nylon, polypropylene or polyurethane may be used, with or without reinforcing fibre.

According to another aspect of the present invention, there is provided a method of manufacturing a games racket frame, comprising the steps of: making a main frame by forming a hollow tubular structure from a composite including a thermosetting material; making at least one additional component including a thermoplastic material; and integrating the or each additional component with the main frame, thereby changing the vibration characteristics of the main frame.

In this method, preferably, the main frame is made by applying the thermosetting material to impregnate the fibrous material, wrapping layers of a fibrous material around a mandrel, so that adjacent layers adhere together, removing the mandrel, and then bending the hollow tubular structure into a desired shape;

the or each additional component is made by injection moulding or the thermoplastic material; and the or each additional component is integrated with the main frame by fitting it around a portion of the main frame and then applying a moulding process to the main frame together with the or each additional component.

Thus, by means of the present invention, one or more additional components including thermoplastic material are consolidated into the structure of a main frame formed using thermosetting material, thereby improving the vibration damping properties of the games racket frame.

BRIEF DESCRIPTION OF THE DRAWING

Reference will now be made, by way of example only, to the accompanying drawings in which:

FIGS. 3, 4 and 5 show first, second and third examples of an injected moulded component used in a games racket frame according to the present invention; and FIG. 6 illustrates the positioning of the components shown in FIGS. 3, 4 and 5 on a main frame of a games racket according to the present invention.

DETAILED DESCRIPTION OF THE INVENTION

Before describing examples of the present invention, the construction of a games racket frame according to the prior art will be explained in more detail with reference to FIGS. 1 and 2.

To obtain the necessary properties of stiffness and strength with low weight, racket frames made from composite materials must be hollow and so it is usual to form sheets of composite material into a hollow tubular structure. This is done by a process of wrapping sheets 13 around a mandrel 11 over which a tubular impermeable membrane 12 is first placed, as shown in FIG. 1.

As mentioned above, the sheets 13 are typically made of carbon, glass or aramid fibre impregnated with an epoxy or other thermosetting resin which is tacky enough to keep the tubular structure together after the mandrel is removed.

Figure 2:
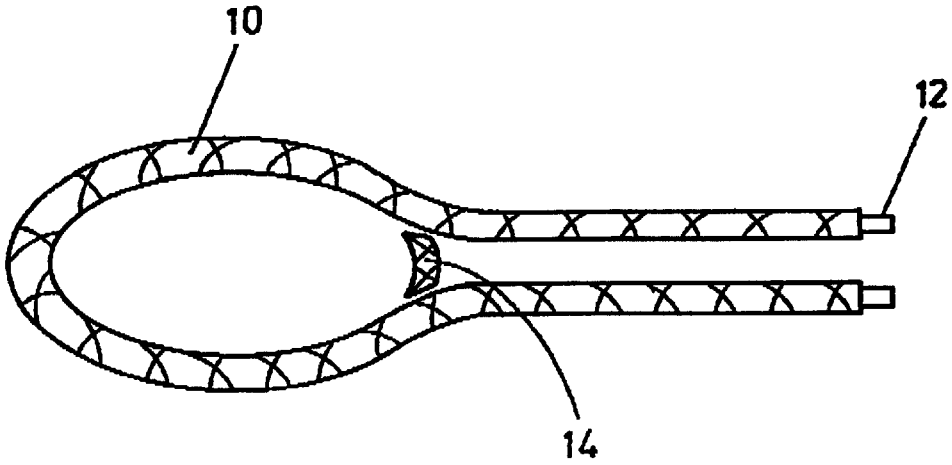
FIG. 2 illustrates how the structure shown in FIG. 1 is shaped to form a main frame of a racket.

On removing the mandrel the complete tubular assembly 10 including the membrane 12 is bent into the general outline of a games racket, for example a keyhole shape with an elliptical head, suitable for a tennis racket, as shown in FIG. 2. The thus-shaped tubular structure is then inserted into a mould defining the main frame of the racket.

To complete the elliptical head of the racket, a bridge piece 14 made from the same composite material used for the main frame 10 is wrapped around a core of cellular plastic material and this is appropriately positioned in the mould. The mould is closed and heated to cure the resin and air-pressure is applied within the tubular membrane 12 to provide consolidating pressure. Heat causes the cellular core of the bridge-piece to expand and produce a similar consolidating action and, under the combined consolidating effect, the bridge piece 14 becomes integrated with the main frame component. On removal from the mould, the racket frame is de-flashed, holes for the racket strings are drilled and a handle fitted.

The structural integrity of the racket structure depends upon the thermosetting resin solidifying under the action of heat so providing adhesion to and cohesion between the elements of the composite material. Generally, the racket properties produced by composites based on thermosetting resins are satisfactory except in the quality of vibration damping. Thermoplastic as distinct from thermosetting resins have been tried and although superior with regard to vibration damping, they introduce problems in the manufacturing process. In particular, thermoplastic resins cannot be readily impregnated into the reinforcing fibres and so the method used has been to combine reinforcing fibres with thermoplastic fibres in a woven structure so that, on moulding under conditions of high temperature and pressure, the thermoplastic fibre melts and flows into the interstices of adjacent reinforcing fibres so that, on cooling, they become integrated into a cohesive structure.

In practice, the flow of thermoplastic material and the 'wetting-out' of reinforcing fibres is difficult to achieve consistently. Moreover, the moulding process must involve both a heating and cooling operation unlike that for thermosetting resins, where only a heating operation is required. Hence the thermoplastic based material leads to a longer and consequently less economic manufacturing operation.

Having explained the drawbacks of the prior art, examples of the present invention will now be described with reference to FIGS. 3 to 6.

Figure 1:
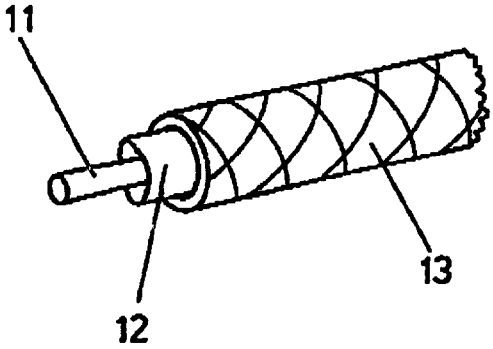
FIG. 1 illustrates the forming of a hollow tubular structure for use in a conventional games racket frame.

It has been found that advantages can be realised if the basic construction of the racket frame, as illustrated in FIGS. 1 and 2, is modified as follows. The main frame is made conventionally by using a thermosetting based composite, but one or more additional components are separately injection moulded from a thermoplastic resin which may incorporate discontinuous (i.e. chopped) fibre reinforcement and these components are incorporated into the moulding process for the main frame so that they become consolidated into the overall frame structure. In particular, the advantage is realised that the additional components improve the vibration damping properties of the racket frame, thereby reducing the shock imparted to the player.

Figure 3:
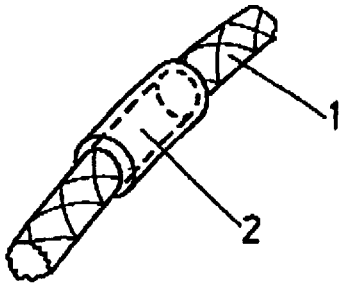
Figure 4:
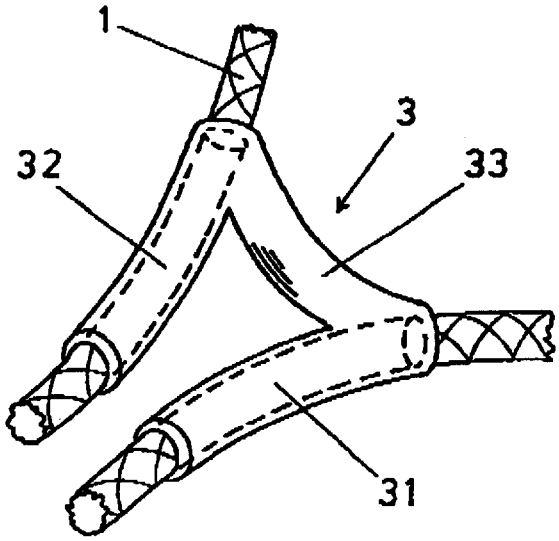

The additional components may be incorporated at various positions for a variety of additional purposes; examples are shown in FIGS. 3, 4 and 5 and their positioning is shown in FIG. 6. FIG. 3 shows an additional component 2 in the shape of a hollow cylinder, the axis of the cylinder being slightly curved to match the curvature of the main frame. Typically, a pair of such components will be provided at corresponding points on either side of the racket head, as shown in FIG. 6.

FIG. 4 shows an additional component 3 provided as the bridge of the racket frame. It has a generally triangular shape in which two legs 31 and 33 fit over respective tubular portions of the main frame and are joined by a curved cross piece 33 which completes the rounded shape (for example, an ellipse) of the racket head. Such an additional component can replace the conventional bridge piece 14 shown in FIG. 2.

A further example of an additional component is shown in FIG. 5. This component 4 is intended for use on a shaft of the racket, and has two legs 42 and 43 joined by merging together into a single body 41 towards the handle (now shown) of the racket. FIG. 5 also shows the tubular membrane 12, which forms part of the main frame tubular assembly, protruding from within the wound sheets of composite material.

In each case, the components are moulded to incorporate internal cylindrical passages into which the main frame 10 is inserted prior to moulding. The mould used to cure the tubular assembly 10 is shaped to accommodate the enlarged outer shape which results after fitting the injection moulded components, and when the mould is closed and heated and pressurisation of the tubular membrane 12 takes place, the injection moulded components become integrated with the main frame 10.

It will be appreciated that the relevant thermosetting and thermoplastic matrix materials can be selected and the moulding temperature chosen so that, while the thermosetting resin can cure, the thermoplastic resin does not melt. If the thermosetting resin is an epoxy and the thermoplastic resin is nylon 66 and the moulding temperature is in the range 145–155° C. then these conditions are met.

The following are examples of suitable materials for the main frame and additional component(s) of the invention but these should not construed as limiting:

| Component | Fibre & Form | Resin & Type | % Fibre/Resin |
|---|---|---|---|
| Main Frame | Carbon/Continuous | Epoxy/ Thermosetting | 60/40 |
| Injection Moulded Components | Carbon/ Discontinuous (chopped) | Nylon 66/ Thermoplastic | 40/60 |

It is pointed out that because the fibre resin to fibre ratio is higher in the case of the injection moulding material than for the thermosetting material, vibration damping properties are even further enhanced as these properties depend on resin proportion as well as resin type.

The injection moulded components may be located in a variety of positions on the racket main frame 10 and these are shown for example in FIG. 6 where:

(1) Two components 2 may be used, not only to improve vibration damping, but to add weight to modify the balance of the frame.

(2) The component 3 may be used, not only to improve vibration damping, but also to provide a bridge instead of using a conventional thermosetting type bridge.

(3) The component 4 may be used not only to improve vibration damping but also to add to the overall stiffness of the shaft and also to incorporate a moulded-in logo 44. Since injection moulding is capable of achieving a smoother surface finish than the moulding process used for the main frame, the logo can be reproduced with high definition.

Of course, any combination of such additional components can be provided on the same games racket frame. In addition, other possible shapes and positions of additional components will occur to those skilled in the art.

What is claimed is:

1. A games racket frame, comprising:

a main frame in the form of a hollow tubular structure made of a fibre reinforced composite including a thermosetting material; and at least one additional component comprising a thermoplastic material and at least one internal through hole, wherein said at least one additional component is fitted around the hollow tubular structure of said main frame.

2. A games racket frame, comprising:

a main frame in the form of a hollow tubular structure made of a fibre reinforced composite including a thermosetting material, wherein said main frame comprises a head for receiving strings, said head having at least one corresponding point; and at least one additional component comprising a thermoplastic material and positioned at said at least one corresponding point, wherein said at least one additional component is in the form of a hollow cylinder, a longitudinal axis of the cylinder being curved to match the curvature of said head where it is positioned.

3. A games racket frame, comprising:

a main frame in the form of a hollow tubular structure made of a fibre reinforced composite including a thermosetting material, wherein said main frame comprises a head for receiving strings, at a lower edge of which two portions of the hollow tubular structure are brought together; and at least one additional component comprising a thermoplastic material and integrated with said main frame, wherein said at least one additional component is provided at said lower edge so as to form a bridge of the racket frame joining the two portions of the hollow tubular structure.

4. The games racket frame according to claim 3, wherein said at least one additional component comprises two legs which are hollow cylinders each having a longitudinal axis curved to match the curvature of the hollow tubular structure where it is positioned, and a cross-piece integrally formed with the legs to join the legs together.

5. A games racket frame, comprising:

a main frame in the form of a hollow tubular structure made of a fibre reinforced composite including a thermosetting material, wherein said main frame comprises a head for receiving strings and a shaft formed by two parallel portions of the hollow tubular structure; and at least one additional component comprising a thermoplastic material and integrated with said main frame, wherein said at least one additional component is provided around said shaft.

6. A games racket frame according to claim 5, wherein said at least one additional component comprises a body passing around both parallel portions of the hollow tubular structure at said shaft, and two legs extending from the body towards said head along respective single portions of the hollow tubular structure.

* * * * *